US012157608B2

(12) United States Patent
Spade

(10) Patent No.: US 12,157,608 B2
(45) Date of Patent: Dec. 3, 2024

(54) WOOD LOG PACKAGING AND CARRYING BAG

(71) Applicant: WOODECO, SIA, Dobeles nov (LV)

(72) Inventor: Martins Spade, Dobeles nov (LV)

( * ) Notice: Subject to any disclaimer, the term of this patent is extended or adjusted under 35 U.S.C. 154(b) by 0 days.

(21) Appl. No.: 18/003,503

(22) PCT Filed: Dec. 19, 2022

(86) PCT No.: PCT/LV2022/050015
§ 371 (c)(1),
(2) Date: Dec. 28, 2022

(87) PCT Pub. No.: WO2023/106904
PCT Pub. Date: Jun. 15, 2023

(65) Prior Publication Data

US 2024/0101311 A1 Mar. 28, 2024

(30) Foreign Application Priority Data

Apr. 19, 2022 (LV) ..... LVP2022000032

(51) Int. Cl.
*B65D 30/00* (2006.01)
*B65D 33/28* (2006.01)
*B65D 85/20* (2006.01)

(52) U.S. Cl.
CPC ..... *B65D 29/00* (2013.01); *B65D 33/28* (2013.01); *B65D 85/20* (2013.01)

(58) Field of Classification Search
CPC ..... B65D 29/00; B65D 33/28; B65D 85/20
USPC ..... 383/72
See application file for complete search history.

(56) References Cited

U.S. PATENT DOCUMENTS 1,385,695 A * 7/1921 Maccormack ..... D06F 95/006 383/92
3,967,668 A * 7/1976 Franco ..... B65D 75/14 383/92
7,448,661 B2 * 11/2008 Daigle ..... B66C 1/18 383/24
2006/0018568 A1 * 1/2006 Costello ..... B65F 1/00 383/117

* cited by examiner

*Primary Examiner* — Jes F Pascua
(74) *Attorney, Agent, or Firm* — Patshegen IP; Moshe Pinchas

(57) ABSTRACT

The present invention relates to wood log packaging and carrying bags. A bag comprises a bag panel (1) having a bottom panel (A), two first side panels (B), and two second side panels (C). The bottom panel (A) has four sides (A3). The bottom panel (A) with its four sides (A3) is permanently joined to the two first side panels (B) and two second side panels (C) and this joint area is also a folding area. Each first side panel (B) and second side panel (C) comprises a through hole (2). The bag comprises a belt (3) attached to the bag panel (1) in the area where the side panels (B) are joined to the bottom panel (A) and configured to be extended through said through holes (2) to firmly hold all four side panels (B; C).

6 Claims, 3 Drawing Sheets

WOOD LOG PACKAGING AND CARRYING BAG

FIELD OF THE INVENTION

The present invention relates to wood log packaging and carrying bags

BACKGROUND OF THE INVENTION

The U.S. Pat. No. 7,172,636 discloses a combustible wood-based package, which includes an outer wrapper, preferably formed from burlap or other similar woven material that encloses large pieces of wood material, medium pieces of wood material and smaller pieces of wood material coated or otherwise soaked in a vegetable wax to form an aggregate. The aggregate is disposed at or near the bottom of the burlap wrapper, with the medium-size pieces of wood material disposed thereon with the larger pieces of wood material disposed on top of the medium-sized pieces of wood material. Another fuel package is disclosed in the U.S. Pat. No. 4,775,391. The package comprising fuel pieces, a combustible moisture proof container for holding the fuel pieces in a specific shape, and combustible binder/starter composition for binding together a large proportion of the fuel pieces into a stack within the container to promote combustion of the fuel pieces when the container is ignited.

The U.S. Pat. No. 5,456,732 discloses a self-kindling fuel package comprising a container with walls and at least one pinched closure with a semi-rigid wick longitudinally folded into the end closure creating an oxygen channel within the end closure, and a method of constructing the self-kindling fuel package.

Various bags and poaches are also disclosed in GB 27883 A A.D. 1912; U.S. Pat. Nos. 1,155,686; 1,474,826 and 3,982,687.

One of the drawbacks of aforementioned prior art is its complexity to easily package wood logs withing these bags. It requires some skill and understanding and may be not suitable for ordinary consumer. Another drawback is its cumbersome carrying. It is object of the invention to provide a packaging and carrying bag that is easy to pack with irregular shape wood logs and easy to carry around.

SUMMARY OF THE INVENTION

Aforementioned drawbacks are overcome and aims are reached by a design of a wood log packaging and carrying bag comprising a bag panel or layout of a bag, wherein the bag panel comprises a bottom panel, two first side panels arranged on each side of the bottom panel and opposed to each other, two second side panels arranged on each side of the bottom panel and opposed to each other.

In more detail it may be explained so. The bottom panel has an exterior surface and an interior surface and four sides. The first side panel and the second side panel has an exterior surface, an interior surface, a top side, a bottom side, a left side, and a right side. The bottom panel with its four sides is permanently joined to the two first side panels through their bottom sides and two second side panels through their bottom sides and the joint area is also a folding area. The bottom panel, first and second side panels are formed as one integral part or a bag panel.

The first side panel and the second side panel comprises a through hole arranged in a proximity of the top side of the first side panel and the top side of the second side panel.

The bag comprises a belt having two ends, wherein each end of the belt is attached to the bag panel in the area where the side panels are joined to the bottom panel at their interior surfaces. Moreover, the holes in the first side panels and the second side panels are arranged so that the belt can be drawn through each hole in each of four side panels when all these side panels are folded.

Two first side panels are folded in a direction to each other over the wood logs arranged on the bottom panel so that one first side panel overlaps another first side panel and the hole of the one first side panel coincides with the hole of another first side panel so that the belt can be extended through both holes of the side panels. Two second side panels are folded in a direction to each other and over the two first side panels so that one second side panel overlaps another second side panel and the hole of the one second side panel coincides with the hole of another second side panel and with the hole of the one first side panel and with the hole of another first side panel so that the belt can be extended through all four holes of the side panels.

In addition the corner between the top side of the second side panel and the left side of the second side panel may be chamfered or rounded, and the corner between the top side of the second side panel and the right side of the second side panel also may be chamfered or rounded.

It is preferable that the bag panel of the bag and the belt is made of jute material.

In the fully assembled or folded state the bag comprises a collection of wood logs so that the bottom panel, two first side panels and two second side panels enclose said collection of the wood logs.

The present invention provides a packaging and carrying bag that is easy to pack with irregular shape wood logs and easy to carry around. The prior art does no discloses or suggests a belt that can be drawn through each of the holes in each first and second side panel in order to achieve an effective closing of the bag, the belt permitting additionally to carry the bag.

BRIEF DESCRIPTION OF THE DRAWINGS

The drawings illustrate generally, by way of example, but not by way of limitation, various embodiments of the invention.

DETAILED DESCRIPTION OF THE EMBODIMENTS

The preferred embodiments of the invention are now described with reference to the figures to illustrate objectives, advantages, and efficiency of the present invention.

Figure 1:
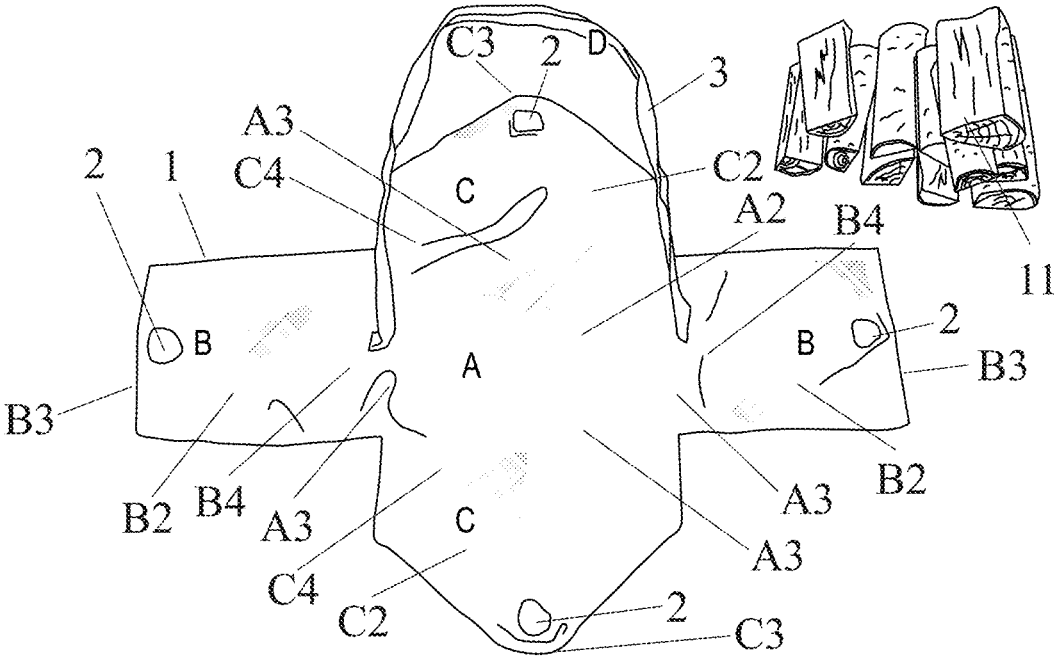
FIG. 1 illustrates a packaging and carrying bag in an un-packed state.

FIG. 1 illustrates a packaging and carrying bag in an un-packed state. The bag comprises a bag panel (1). The bag panel (1) comprises the following parts or panels: a bottom panel (A); two first side panels (B); and two second side panels (C). The bottom panel (A), two first side panels (B) and two second side panels (C) form one integral bag panel (1). The bag panel (1) is made of jute material. The bottom panel (A) has an exterior surface (A1) and an interior surface (A2) and four sides (A3). The exterior surface (A1) is opposite to the interior surface (A2), hence, not directly visible in Figures. The first side panel (B) and the second side panel (C) has an exterior surface (B1; C1), an interior surface (B2; C2), a top side (B3; C3), a bottom side (B4; C4), a left side (B5; C5), and a right side (B6; C6). The bottom panel (A) with its four sides (A3) is permanently joined to the two first side panels (B) through their bottom sides (B4) and two second side panels (C) through their bottom sides (C4) and the joint area is also a folding area. Each first side panel (B) and second side panel (C) comprises a through hole (2) arranged in a proximity of the top side (B3) of the first side panel (B) and the top side (C3) of the second side panel (C). The bag comprises a belt (3) having two ends. Each end of the belt (3) is attached to the bag panel (1) in the area where the side panels (B) are joined to the bottom panel (A) at their interior surfaces (A2; B2). Moreover, corner between the top side (C3) of the second side panel (C) and the left side (C5) of the second side panel (C) are chamfered and corners between the top side (C3) of the second side panel (C) and the right (C6) of the second side panel (C) are also chamfered.

Figure 2:
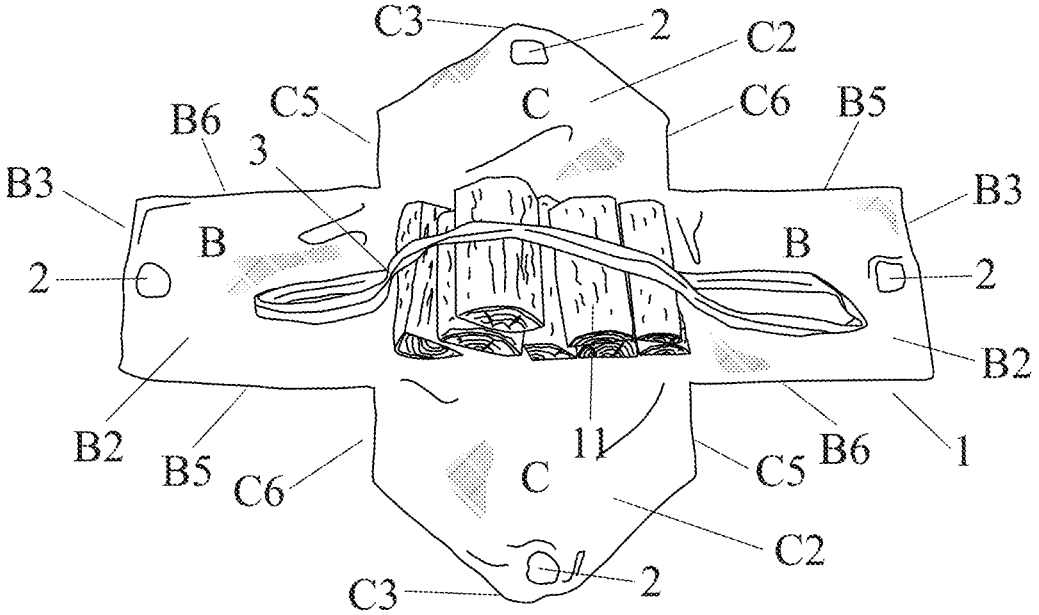
FIG. 2 illustrates the bag as shown in FIG. 1, wherein wood logs are arranged on a bottom panel (A) of the bag.

FIG. 2 illustrates the bag as shown in FIG. 1. Wood logs (11) are arranged on a bottom panel (A) of the bag and the belt (3) is arranged over these wood logs (11).

Figure 3:
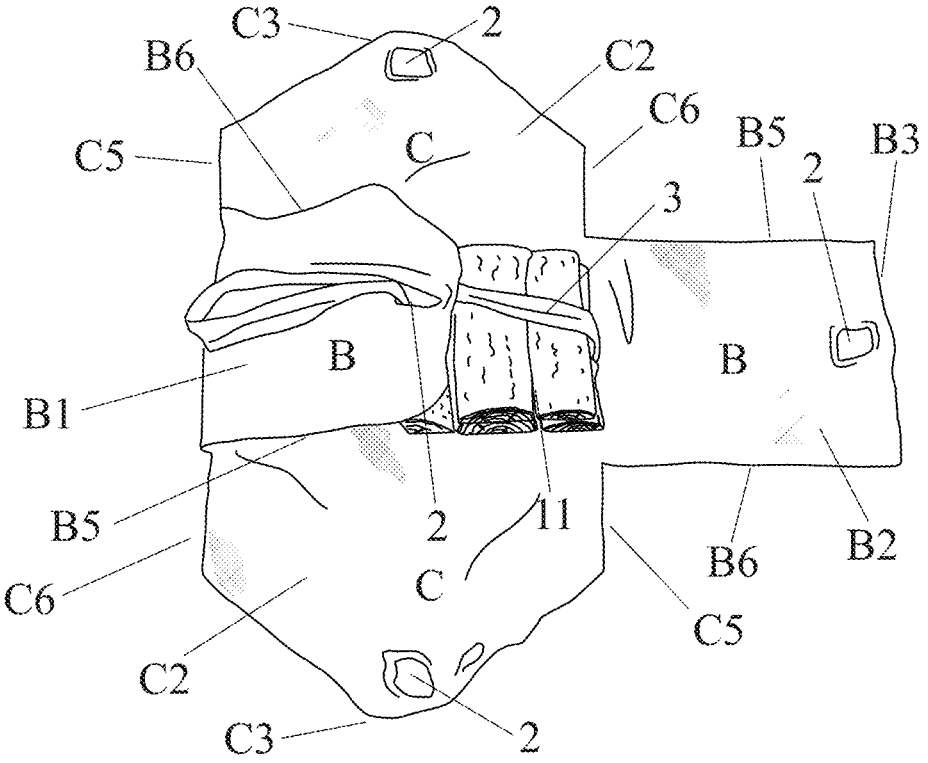
FIG. 3 illustrates the bag as shown in FIGS. 1 and 2, wherein one of two first side panels (B) is folded over the wood logs and a belt (3) is drawn through a hole in the first side panel (B).

FIG. 3 illustrates the bag as shown in FIGS. 1 and 2. One of two first side panels (B) is folded over the wood logs (11) and a belt (3) is drawn through a hole in the first side panel (B). The first side panel (B) is folded at its bottom side (B4).

Figure 4:
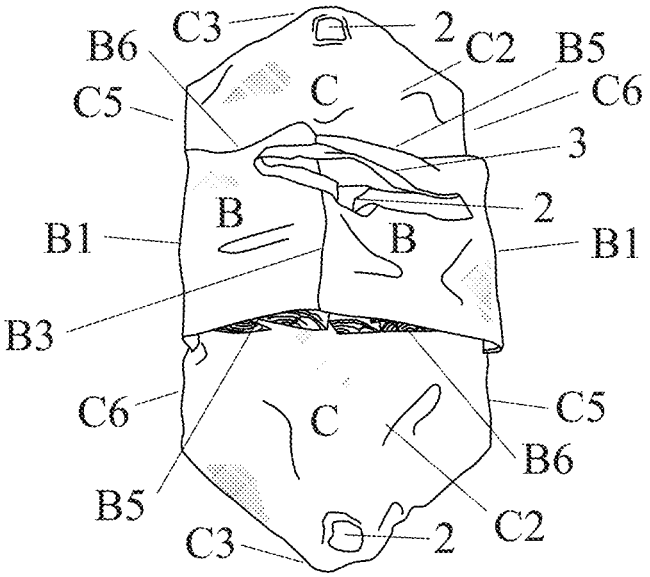
FIG. 4 illustrates the bag as shown in FIGS. 1 to 3, wherein both first side panels (B) are folded over the wood logs and a belt (3) is drawn through both holes (2) of both first side panels (B).

FIG. 4 illustrates the bag as shown in FIGS. 1 to 3. Both first side panels (B) are folded over the wood logs and a belt (3) is drawn through both holes (2) of both first side panels (B). Both first side panels (B) are folded at its bottom sides (B4). The length of the first side panels (B) is such that in the folded state both first side panels (B) fully cover the wood logs (11) from above and from two of its (wood logs) four sides.

Figure 5:
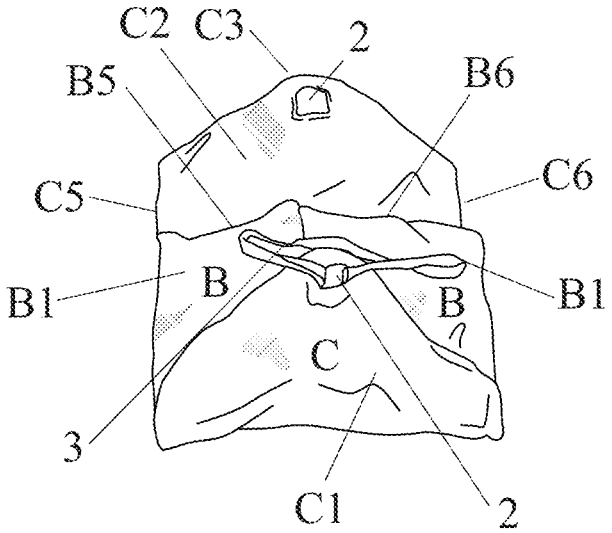
FIG. 5 illustrates the bag as shown in FIGS. 1 to 4, wherein one of two second side panels (C) is folded over the both first side panels (B) and the belt (3) is drawn through a hole (2) in the second side panel (C).

FIG. 5 illustrates the bag as shown in FIGS. 1 to 4, wherein one of two second side panels (C) is folded over the both first side panels (B) and the belt (3) is drawn through a hole (2) in the second side panel (C). The second side panel (C) is folded at its bottom side (C4).

Figure 6:
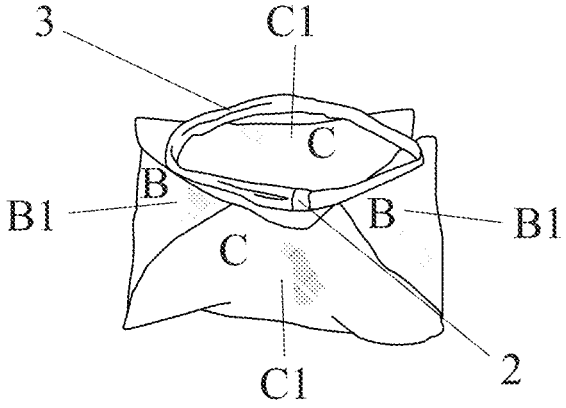
FIG. 6 illustrates the bag as shown in FIGS. 1 to 5, wherein both second side panels (C) are folded over both first side panels (B) and a belt (3) is drawn through both holes (2) of both second side panels (C) and the bag is fully packed and ready to be carried.

FIG. 6 illustrates the bag as shown in FIGS. 1 to 5. Both second side panels (C) are folded over both first side panels (B) and a belt (3) is drawn through both holes (2) of both second side panels (C). Both second side panels (C) are folded at their bottom sides (C4). The wood logs (11) are fully enclosed by the bag panel (1). The bag is fully packed and ready to be carried by means of the belt (3).

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims, if present.

The invention claimed is:

1. A wood log packaging and carrying bag comprising:

a bag panel (1), wherein the bag panel (1) comprises:
- a bottom panel (A);
- two first side panels (B);
- two second side panels (C);

wherein the bottom panel (A) has an exterior surface (A1) and an interior surface (A2) and four sides (A3);

wherein the first side panel (B) and the second side panel (C) has an exterior surface (B1; C1), an interior surface (B2; C2), a top side (B3; C3), a bottom side (B4; C4), a left side (B5; C5), and a right side (B6; C6);

wherein the bottom panel (A) with its four sides (A3) is permanently joined to the two first side panels (B) through their bottom sides (B4) and two second side panels (C) through their bottom sides (C4) and the joint area is also a folding area;

wherein each first side panel (B) and second side panel (C) comprises a through hole (2) arranged in a proximity of the top side (B3) of the first side panel (B) and the top side (C3) of the second side panel (C);

a belt (3) with two ends, wherein each end of the belt (3) is attached to the bag panel (1) in the area where the side panels (B) are joined to the bottom panel (A) at their interior surfaces (A2; B2).

2. The bag according to claim 1, characterized in that two first side panels (B) are folded in a direction to each other so that one first side panel (B) overlaps another first side panel (B) and the hole (2) of the one first side panel (B) coincides with the hole (2) of another first side panel (B) so that the belt (3) can be extended through both holes (2) of the side panels (B);

two second side panels (C) are folded in a direction to each other so that one second side panel (C) overlaps another second side panel (C) and the hole (2) of the one second side panel (C) coincides with the hole (2) of another second side panel (C) and with the hole (2) of the one first side panel (B) and with the hole (2) of another first side panel (B) so that the belt (3) can be extended through all four holes (2) of the side panels (B; C).

3. The bag according to claim 1 characterized in that the wherein a corner between the top side (C3) of the second side panel (C) and the left side (C5) of the second side panel (C) is chamfered and a corner between the top side (C3) of the second side panel (C) and the right side (C6) of the second side panel (C) is chamfered.

4. The bag according to claim 1 characterized in that the wherein a corner between the top side (C3) of the second side panel (C) and the left side (C5) of the second side panel (C) is rounded and a corner between the top side (C3) of the second side panel (C) and the right side (C6) of the second side panel (C) is rounded.

5. The bag according to claim 1, characterized in that the bag panel (1) of the bag and the belt (3) is made of jute material.

6. The bag according to claim 1, characterized in that it comprises a collection of wood logs (11) within the bag so that the bottom panel (A), two first side panels (B) and two second side panels (C) enclose said collection of the wood logs (11).

* * * * *